US005869148A

United States Patent [19]

Silverschotz et al.

[11] Patent Number: 5,869,148

[45] Date of Patent: Feb. 9, 1999

[54] PROCESS FOR THE IN-LINE, HIGH SPEED MANUFACTURING OF MAGNETIC PRODUCTS

[75] Inventors: Stanford B. Silverschotz, Livingston; Louis Rua, Jr., Plainsboro; Christopher Tararuj, Trenton, all of N.J.; Armin A. Apel, North Palm Beach, Fla.; George P. Hipko, Milltown, N.J.

[73] Assignee: Webcraft Technologies Inc., Lawrenceville, N.J.

[21] Appl. No.: 16,205

[22] Filed: Feb. 9, 1993

Related U.S. Application Data

[63] Continuation of Ser. No. 690,535, Apr. 23, 1991, abandoned.

[51] Int. Cl.[6] ..... H01F 1/00

[52] U.S. Cl. ..... 427/549; 427/128; 427/129; 427/130; 427/261; 427/290; 427/385.5; 427/428; 427/434.2; 427/542; 427/549; 427/553; 427/591; 427/598

[58] Field of Search ..... 427/598, 599, 427/127–132, 549, 261, 290, 428, 434.2, 385.5, 542, 553, 591

[56] References Cited

U.S. PATENT DOCUMENTS

| | | | |
|---|---|---|---|
| 3,665,355 | 5/1972 | Sasaki et al. | 335/306 |
| 3,790,407 | 2/1974 | Merten et al. | 117/240 |
| 4,101,904 | 7/1978 | Weigl et al. | 346/74.1 |
| 4,791,032 | 12/1988 | Komatsu et al. | 427/599 X |
| 5,229,173 | 7/1993 | Suzuki et al. | 427/599 |
| 5,525,649 | 6/1996 | Nishimura et al. | 523/322 |

*Primary Examiner*—Bernard Pianalto
*Attorney, Agent, or Firm*—Anderson, Kill & Olick, P.C.

[57] ABSTRACT

A process for the in-line, high speed manufacturing of magnetic products is disclosed. The process comprises the steps of printing onto a substrate, drying the ink print, making the appropriate cuts or scores on the substrate, applying a slurry of magnetizable material onto the substrate to create the magnet, drying the applied material, magnetizing the magnetic material and cutting and forming the substrate to the desired dimensions. Each of these steps may be performed in a single, in-line manufacturing operation running at high speeds.

35 Claims, 9 Drawing Sheets

PROCESS FOR THE IN-LINE, HIGH SPEED MANUFACTURING OF MAGNETIC PRODUCTS

This application is a continuation of Ser. No. 07/690,535 filed Apr. 23, 1991 and now abandoned.

FIELD OF THE INVENTION

The present invention is directed to magnetic products and to an apparatus and process for the manufacturing thereof and more particularly to a web based as well as a sheet fed in-line, high speed apparatus and process for manufacturing magnetic products, including the steps of printing a message onto a substrate, applying a slurry of magnetizable material onto the substrate, magnetizing the magnetic material and cutting and forming the magnetic products to the desired shape.

BACKGROUND OF THE INVENTION

Flexible magnets today typically consist of a magnetic powder such as barium ferrite in a rubber-like or rigid binder extruded by commonly known techniques for extruding rubber or polymer materials. The extrusion is usually in the form of self-supporting sheets of various thicknesses. The magnetization of the material is performed commonly by moving these sheets through a device which employs high intensity magnetic fields to impart permanent magnetic properties to the sheet. The magnetized material may then be cut into any desired shape and adhered to steel walled appliances such as refrigerators, steel file cabinets and bulletin boards in offices or to certain furniture in the home.

A sheet of a suitable material, printed with advertising information, decorative patterns or any other desired graphic design may be adhered before or after the cutting by methods disclosed in U.S. Pat. No. 4,310,978. The use of magnets as an advertising tool, however, is not always commercially feasible because of the expense involved in adhering a magnet to such a sheet. This is particularly true where one is trying both to: 1) produce the separate magnet and printed sheet components; and 2) combine the two items into one package.

It is accordingly an object of the present invention to provide a simple, low-cost, in-line apparatus and process for the manufacturing of magnetic products which may be formed as an integral part of a large non-magnetic substrate.

Another object of the invention is to waste less magnetic material compared to present manufacturing processes which use, for example, conventional rubberized, pre-magnetized sheets or rolls of material.

Yet another object of the invention is to provide an efficient apparatus and process for the in-line production of magnets.

Still another object of this invention is to provide a high speed apparatus for magnetization.

SUMMARY OF THE INVENTION

To achieve these and other aspects of the invention, which will become apparent hereinafter, an "APPARATUS AND PROCESS FOR THE IN-LINE, HIGH SPEED MANUFACTURING OF MAGNETIC PRODUCTS" is disclosed, comprising the steps of producing, for example, an advertisement by printing a message onto a paper or other substrate, drying the ink print, making the appropriate cuts or scores on the substrate, applying a slurry of magnetizable material onto the substrate to create the magnet, drying the applied material, magnetizing the magnetic material and cutting and forming the substrate to the desired dimensions. Each of these steps may be performed in a single, in-line manufacturing operation running at high-speeds, e.g. 600 feet per minute (180 meters per minute).

Applicants' invention includes additionally a novel design for magnetizing equipment to magnetize magnetizable material on flexible, non-magnetic or paramagnetic substrates at high speeds. It further includes methods for enhancing magnetic strength by improving crystal alignment of the magnetizable material when a slurry of such material is applied to the substrate and for significantly increasing the mass of the magnetic material being applied.

BRIEF DESCRIPTION OF THE DRAWINGS

The invention will be better understood by reading the Detailed Description of the Preferred Embodiment" in conjunction with the appended drawings, of which.

DETAILED DESCRIPTION OF THE PREFERRED EMBODIMENTS

Figure 1:
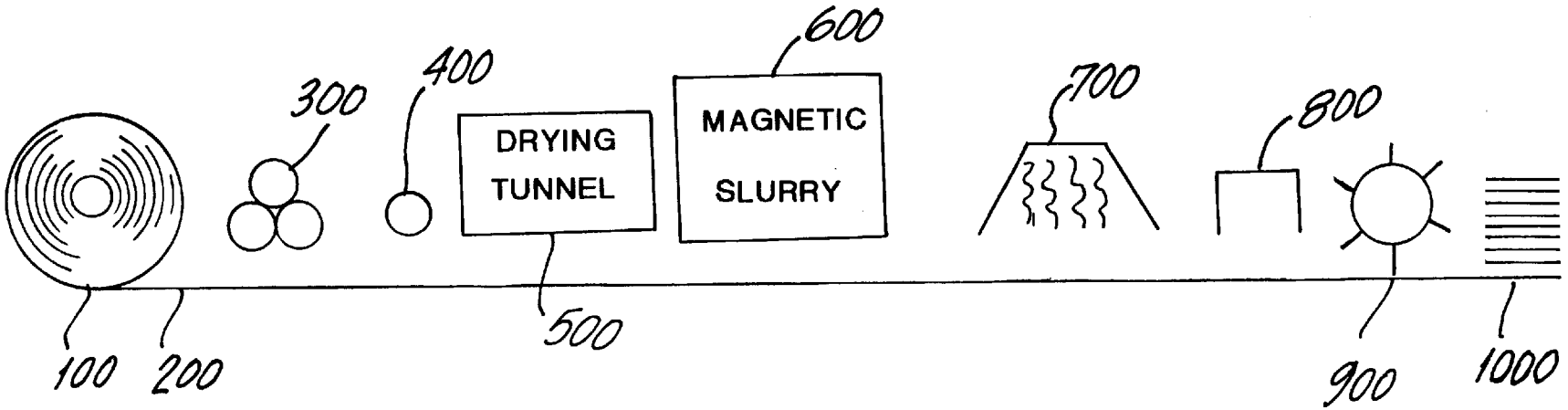
FIG. 1 is a schematic, side view of the apparatus and process for the in-line, high speed manufacturing of magnetic products on a substrate web.

Referring now to the drawings, wherein identical numerals indicate identical parts throughout the several views, FIG. 1 schematically shows applicants' apparatus and process for the in-line, high speed manufacturing of magnetic products having a roll of substrate material 100, from which is unrolled web 200. The web 200 may be printed with a message or advertisement by passing it through a printing section, indicated schematically and generally by 300, where successive images ("repeats") are printed. The web 200 is comprised of any flexible, non-magnetic or paramagnetic material such as paper, plastic, cloth or aluminum foil. Aluminum foil is used only in connection with permanent magnetization. The web printing press (not shown) employed in printing section 300, is of a type generally known in the art. The press may use printing techniques such as lithography, flexography, gravure, silk screen, inkjet, xerographic and others. An optional polymeric undercoating may be applied to the web at area 400. This coating may be useful in sealing a porous substrate to prevent leak-through of applied magnetic material to the reverse side of the web 200. Such leak-through would not impair the function of the product but could degrade its appearance and thereby decrease commercial appeal.

The processed web 200 is printed with the printed graphic content and an optional undercoat, is dried at area 500 which may include a hot air or infrared drying tunnel (not shown) and is moved through a magnetic slurry application section, generally indicated by 600.

Magnetizable material 601 (see FIG. 4) is applied to the web 200 at area 600 by any one of a number of techniques known to those skilled in the art, on the areas of the web 200 to be coated by the magnetic slurry. Such material should typically have a coercivity between 1,300 and 10,000 Oersteds. Application of the slurry of magnetizable material is performed by first making a liquid blend containing a magnetizable powder in a solution or suspension of a polymer resin in a solvent, in a hot-melt polymer, or wax, or an aqueous polymer emulsion system. In both aqueous or solvent based systems, the polymer is between 2 and 20% and preferably between 4 and 8% by weight of the total formula. In a hot-melt polymer binder system, the polymer is preferably 30 to 60% by weight of the mixture.

Ferrite powder is added to this liquid to a level of 40–80%, but preferably 70% by weight of the total formulation. The solvent or vehicle for the liquid can be either water or an organic solvent, depending upon the desired features. Water is environmentally preferable, although polymers are generally more soluble in organic solvents which usually evaporate faster than water. A system employing a hot-melt binder (such as wax) eliminates the need for drying. The mixture is blended in a mixer (not shown) equipped with a Cowles type or similarly suitable dispersing blade until it is smooth and uniform. Ball mills or other dispersing means may also be used. Either of the two formulas below are examples of equally suitable slurry formulations:

| Formula #1 | % | Formula #2 | % |
|---|---|---|---|
| Polyamide resin | 6.0 | Acrylic emulsion | 10.9 |
| n-propanol | 9.0 | Water | 32.6 |
| Isopropanol | 10.4 | Dispersant | 1.4 |
| VM&P naptha | 8.9 | Defoamer | 0.2 |
| Dispersant | 1.0 | Barium ferrite | 54.9 |
| Strontium ferrite | 64.7 | | |

A binder is selected and incorporated in the slurry to assure adhesion of the magnetic coating to the web. The binder can be of any flexible polymer or similar materials, such as acrylics, vinyls, polyamides, polyesters, waxes, silicates, dryable oils, cellulosics, polyurethanes or silicones with sufficient adhesion both to the web 200 and to the magnetic particles.

The magnetic material 601 may be applied at area 600 by screen printing, flexographic printing, roller (direct wheel) or the doctor blade method. The most preferred methods however are by the reverse wheel or extrusion (see FIGS. 5 and 6) techniques. Care should be taken to assure that sufficient material 601 is applied. Applicants have found that half of the needed material 601 may be applied on two opposing places on the web (see FIG. 4) and the two parts may subsequently be brought together to achieve a final thickness which produce greater magnetic remanence than a single magnetic application of double thickness. Alternatively, several sequential applications, each followed by drying, can be made to the same area to build up the required thickness. By using a coating 601 containing a ferrite crystal powder which will have a remanent magnetic field after it is applied to the web 200 and subjected to a sufficiently powerful magnetizing field, an inexpensive magnet may be produced on a continuous web 200 with accompanying printed information or advertising.

The liquid blend (also referred to herein as a "slurry") may be applied, as indicated above, by any one of several known printing techniques. Applicants have found the use of a wiping "reverse roller" applicator (see FIG. 5), which influences crystal alignment and also provides a thick coating, to be one of the two most preferable methods of slurry application. A thick coating between 0.004 inches (0.1 mm) and 0.020 inches (0.5 mm) and preferably between 0.006 inches (0.15 mm) and 0.012 inches (0.3 mm) of magnetic material 601 is needed to produce an effective magnet.

The wiping reverse roller applicator aligns the hexagonal platelet crystals of the slurry in the preferred aligned orientation with their large planes parallel both to each other and to the substrate so that the alignment of their anisotropic domains can be forced perpendicular to the large flat crystal planes. The larger the percentage of crystals so aligned, the greater the magnetic field that can be obtained for a given mass.

Figure 5:
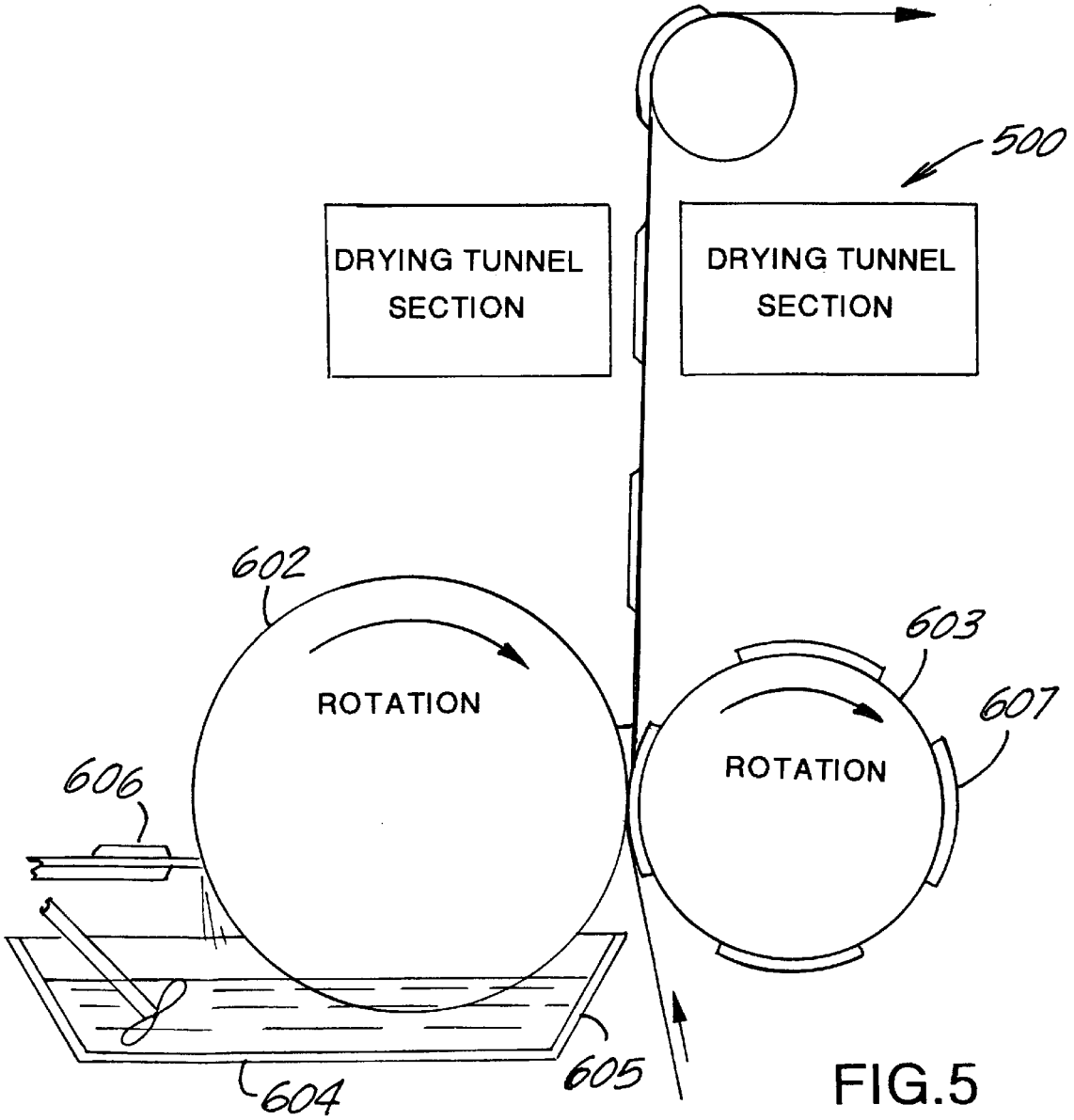
FIG. 5 is a schematic view of a "reverse roller" technique used for the application of magnetic slurry onto a web substrate.
Figure 6A:
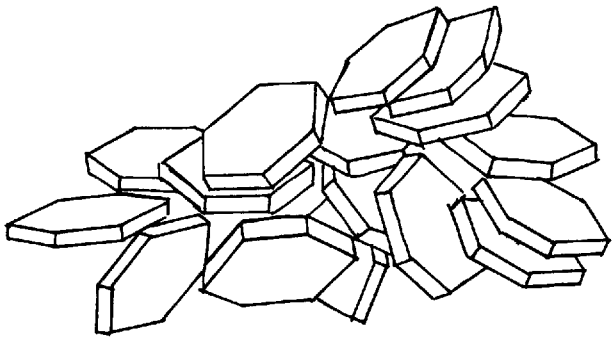
FIG. 6A is a perspective view depicting the crystal platelets of the slurry in a random orientation prior to application.
Figure 6B:
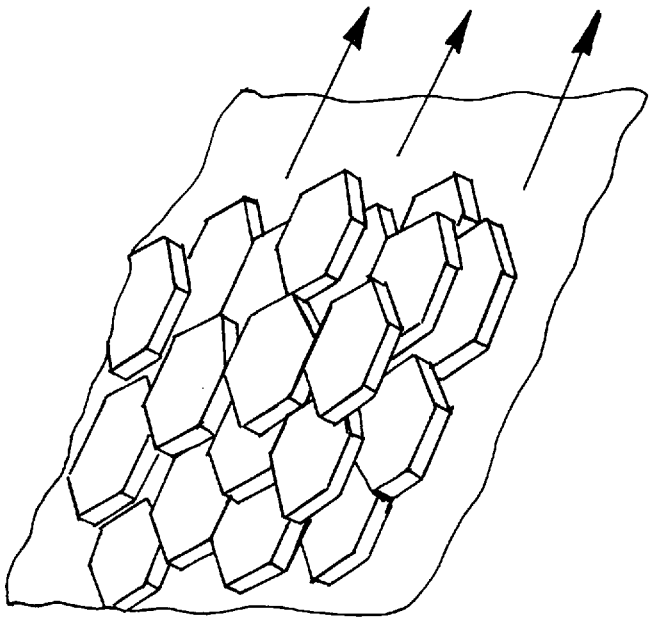
FIG. 6B is a perspective view depicting crystal platelets in an aligned orientation upon application by the reverse roller or extrusion methods.

FIG. 5 is a schematic depiction of the reverse roller technique for the application of magnetic slurry onto the web substrate 200. The web 200 passes between a coating roller 602, which is a large continuously-rotating drum and a rotating plate cylinder 603. A certain portion of the rotating coating roller 602 is, at any given moment, in magnetic slurry 604 in a coating pan 605. The platelets in the coating pan 605 are in a random orientation as shown in FIG. 6A. At point A of the coating roller 602, a doctor-blade assembly 606 measures the thickness of the slurry 604 which has adhered to the roller 602 and returns excess slurry to the pan 605. Point A of the roller 602 rotates and meets the web 200 at point B. Plates 607 projecting from the rotating plate cylinder 603, push the web 200 against coating roller 602 for better application of the slurry 604. The slurry 604 is applied to the web 200 in a wiping action caused by rotation of the coating roller 602 in a direction opposite to the movement of the web 200 (hence the term "reverse roller"). This action applies a thick slurry coating to the web 200 and also imparts the preferred alignment of the crystals for better magnetic properties. FIG. 6B shows, in a rather idealized form, the alignment of crystal platelets at point "B" of FIG. 5 due to the wiping action of the reverse wheel application process. The web then continues toward drying stage 500 and the subsequent steps of the apparatus and process.

Figure 7:
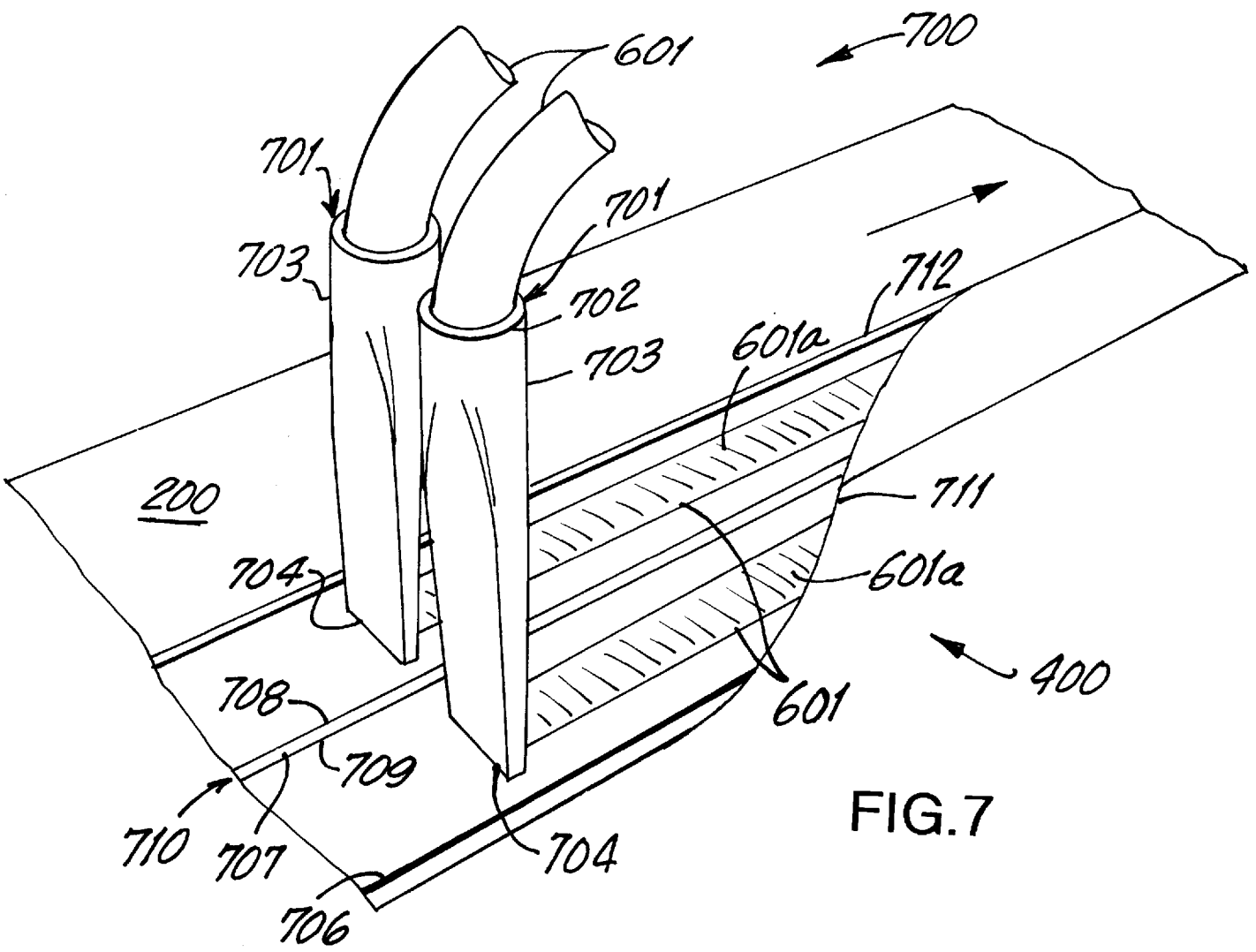
FIG. 7 is a perspective view of an extrusion technique for the application of the magnetic slurry onto a web substrate.

FIG. 7 shows a perspective view of an extrusion technique, generally depicted by 700, for the application of magnetic slurry 601 onto web substrate 200 which travels in the indicated direction. Magnetic slurry 601 is pumped by suitable mechanism through nozzle supply lines, which are fitted into the extrusion nozzles 701, at the nozzle's widest point 702, which has a circular cross-section. The slurry proceeds through a gradually tapered section 703, where the crystal platelets are forced to become aligned toward the rectangular cross-section nozzle opening 704, which is the narrowest point of the nozzle 701 where the exiting slurry contains the greatest number of preferably aligned crystal platelets. By adjusting the slurry supply pump settings and the distance from the nozzle opening 704 to the substrate 200, the desired quantity of magnetic material 601 can be applied.

Adhesive materials can be applied to the web substrate 200 in an in-line gluing station, along, for example, strips 705, 706 and 707. Strip 707 has edges 708, 709 approximately equidistant from the centerline 710 of web 200. When the substrate is folded at 400 at a web folding station (see FIG. 4), edge 711 of the web is brought into contact with line 712 so that adhesive strip 706 overlies strip 705 and becomes permanently bonded to it. Similarly, the folding operation causes strip 707 to fold along centerline 710 so that edges 708 and 709 "meet" and one-half of strip 707 becomes permanently bonded to the other half. The folding procedure also causes magnetic slurry strip 601(*a*) and 601(*b*) to come together to form a combined strip of double the thickness of the individual strips 601(*a*), 601(*b*).

The required viscosity for application to the web varies with the technique used for application. For the reverse roller method, the viscosity should be 300 centipoise to 5,000 centipoise, but preferably between 3,000 and 4,000 centipoise. For the extrusion method, the viscosity may be 30,000 to 150,000 centipoise but preferably between 40,000 and 60,000 centipoise.

Figure 4:
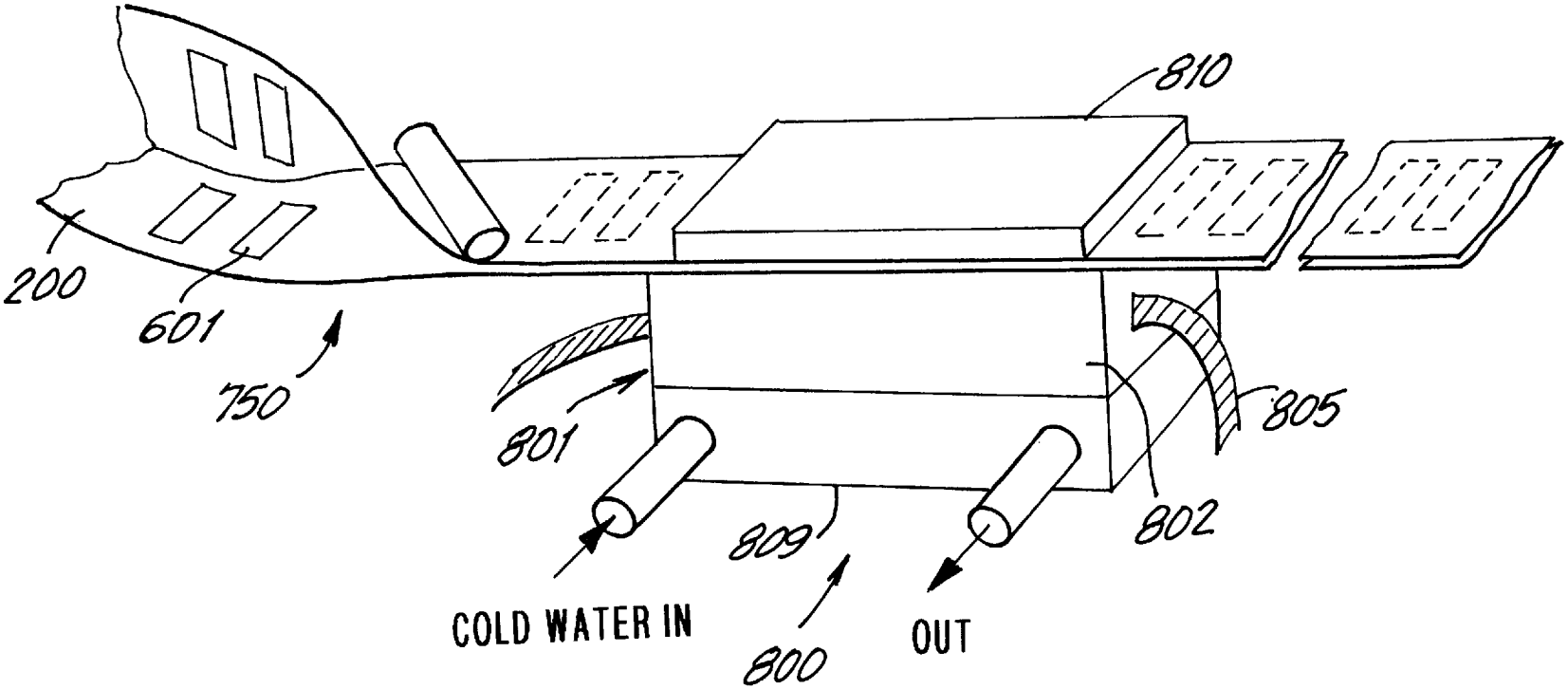
FIG. 4 is a perspective, schematic view of a web folding station and magnetizing inductor of the apparatus and process.

After application of the slurry of magnetizable material to the substrate, the volatile solvent or water is evaporated or dried at another drying stage 700 to form a solid, dried coating of magnetic powder in a polymer binder. The drying stage 700 employs typical drying devices such as infrared heaters (not shown) and may be followed by several gluing stations (not shown), preferably comprising roll applicators, several in-line folding stations, preferably comprising mechanical folding devices. FIG. 4 is a perspective schematic view of a web folding stage 750 which is followed by a magnetizing stage 800.

Often during the production of conventional magnets such as flat sheet rubber magnets, the exterior walls of the cured rubber extrusion are sliced off and laminated, while the the center section of the extrusion is discarded. Such a process takes advantage of the fact that ferrite crystal platelets tend to align in the preferred orientation (for subsequent magnetization) closest to the walls of the extrusion die, while the platelets passing through the center of the die tend to remain more randomly oriented. Applicants have effectively achieved a similar result by extruding two lines of material through narrow slot orifices. The paper is then folded so that, in effect, two extrusions are simultaneously obtained.

The magnetic domains within the individual crystal particles embedded in the dried coating are unoriented so that they do not reinforce each other in the crystal and therefore lack significant net bulk magnetic remanence. In order to align the magnetic domains within the crystals and impart magnetic remanence, the coating must be subjected to a strong magnetic field by imposing sufficiently high intensity electrically generated magnetic pulses or pulses generated by a permanent magnet. Alternatively, the magnetic field may be imposed by a permanent magnet of sufficient magnetic field strength. The preferred method of magnetization could be performed as shown in U.S. Pat. No. 4,379,276, which is directed to a process and apparatus for the multipolar magnetization of a material in strips.

Figure 3A:
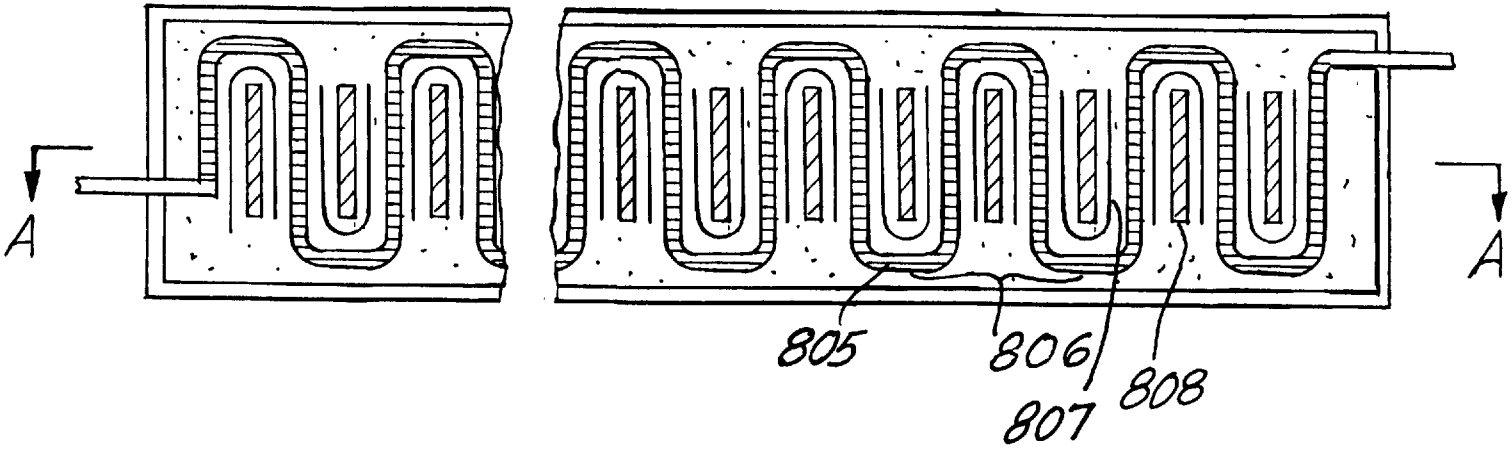
FIG. 3A is a schematic view of primarily the magnetizing inductor of the apparatus and process.
Figure 3B:
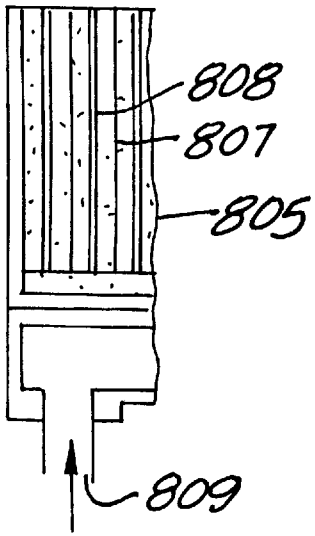
FIG. 3B is a cross-sectional view across line A—A of the magnetizing inductor of FIG. 3A.

The details of the electrical induction magnetizing unit 801 at magnetizing stage 800 are depicted in FIG. 4 with further details of the serpentine shaped magnetizing inductor 802 shown in FIG. 3. The magnetic unit 801 can be arranged, for example, to provide a two (2) inches/(5 cm) wide by two to six (2–6) inches/(5–15 cm) long area over the magnetizing inductor 802 where magnetization occurs. The longer the inductor 802, the higher the impedance, which makes it more difficult and more expensive to obtain the required discharge currents.

Applicants' electical induction system performs at high web speeds, for example, up to six hundred (600) feet (180 meters) per minute and the repetitive pulsing of the apparatus occurs at a rate sufficiently fast that, coupled with the length of the magnetizing inductor 802 and the size of the magnetizing inductor's poles, magnetization of the dried film 601 can be achieved continually and uniformly along the entire length of the web 200.

Figure 2:
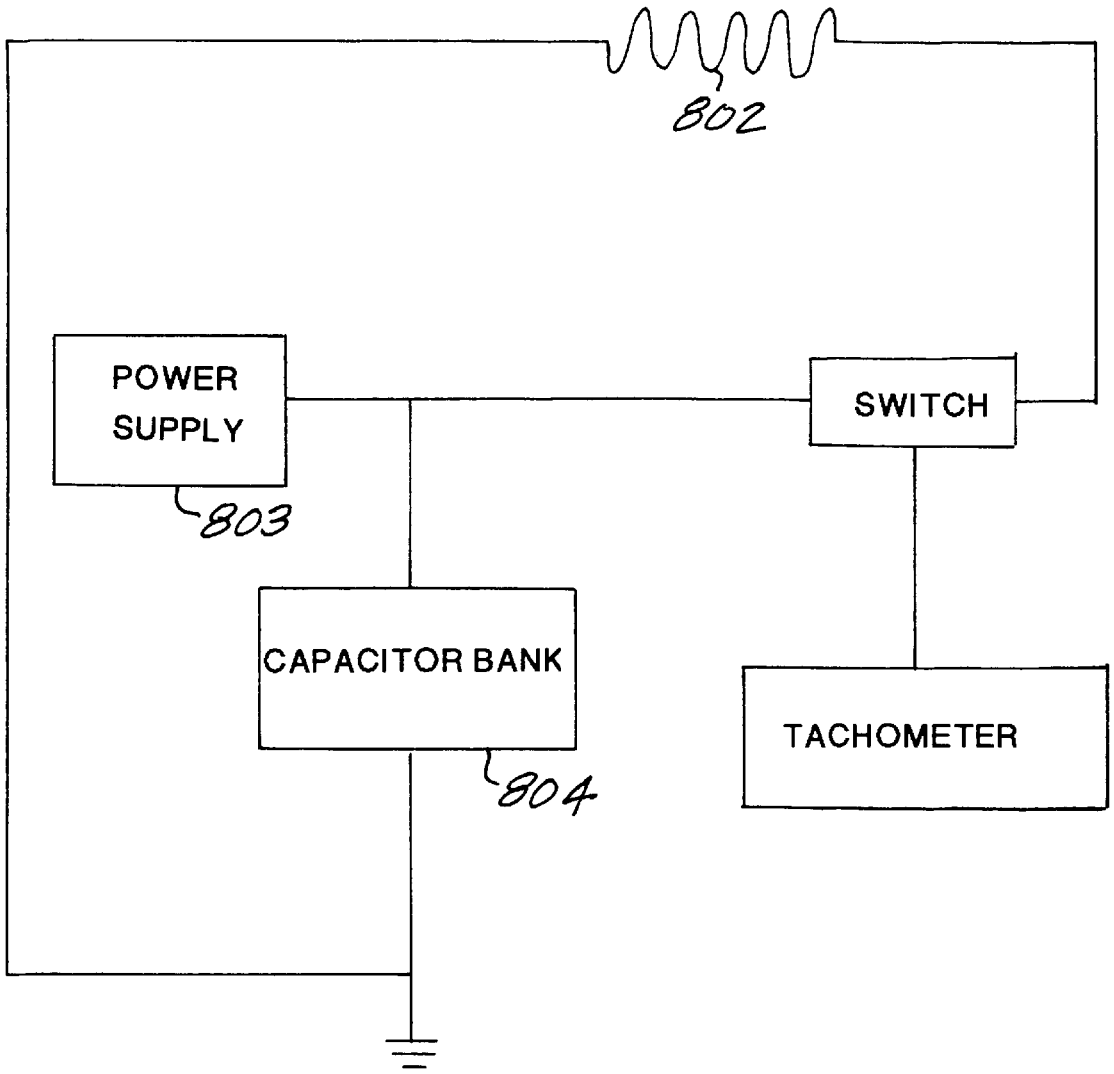
FIG. 2 is an electrical block diagram of the circuitry associated with the magnetization unit of the apparatus and process.

The power supply 803 (see FIG. 2) of the magnetizing unit 801 must be sufficiently large so that the output voltage can generate a current of 1,500 to 10,000 Amperes through the impedance of the magnetizing inductor. Applicants have determined that in order to generate the necessary field for magnetizing the magnetic slurry formulations with the magnetizing inductor 802 described below, a current of 3,000 Amperes is preferred. This current is generated by a capacitor bank 804 (see FIG. 2) charged to 3,000 Volts and discharged through an inductor of one (1) ohm impedance.

The magnetizing inductor 802 of FIG. 3 is 6 inches (15 cm) long and constructed from copper ribbon 805 of sufficient gauge to handle the current. The copper ribbon 805 is 0.25 inch (6.5 mm) wide and 0.025 inch (0.65 mm) thick and is folded in a serpentine configuration such that a 2 inches (5 cm) wide inductor results from fold to fold. The spacing 806 between the serpentine folds is typically 0.083–0.125 inch (3.25 mm), accommodating insulation 807 and five strips of 0.005 inch (0.13 mm) thick soft iron sheets 808 (such as commercially used in transformer laminations) between each fold. The serpentine ribbon 805 and lamination structure are then potted with an epoxy compound onto a heat sink (not shown). The top of this assembly was machined flat and surface ground to provide good contact with the web 200. This subassembly can then be mounted into a larger heat sink (not shown) having a water cooling unit 809 (see FIG. 4). Typical impedances are from one to several Ohms depending on the length of the assembly.

A soft iron plate 810 (see FIG. 4) is placed above the web 200 opposite the magnetizing inductor 802 to complete the magnetic circuit. The web 200 is passed over the potted magnetizing inductor 802 and under the iron plate 810 so that the magnetic field passes through the magnetizable layer applied on the web 200 in the magnetizing unit 801 (see FIG. 4).

The capacitor bank 804 of the circuitry (See FIG. 2) associated with the magnetization unit is charged from a power supply 803 and discharged through the magnetizing inductor 802 at a sufficient pulse rate so that the continuous strip of magnetic material has a magnetic remanence imparted to it as it passes over the inductor 802. The pulse rate is dependent upon the length of the magnetizing inductor 802 and the web speed. Since the web motion is the variable in this relationship and the magnetizing inductor 802 length is fixed, the web speed controls the pulsing rate. Provisions have therefore been made to synchronize the pulsing rate with the web speed. For each time period in which the web 200 moves a distance equal to the length of the magnetizing inductor 802, the apparatus must be pulsed once. For a six (6) inch (15 cm) long magnetizing inductor 802 and a web speed of 600 feet (180 m) per minute, the pulsing rate will be 20 pulses per second (600 feet divided by 6 inches=1200 pulses per minute divided by 60 seconds=20 pulses per second).

Applicants have determined that the minimum pulse length required to align the magnetic domains is 3 microseconds. The maximum pulse length is dependent on the web speed and at 600 feet per minute should not exceed 10 microseconds. Applicants have also determined that a pulse longer than 10 microseconds does not increase the resulting remanence imparted to the magnetic material.

In one embodiment, the specifications of the pulse source (not shown) and the carrier (not shown) used with a magnetizing inductor 802 to magnetize a 0.006 to 0.012 inches (0.15 to 0.3 mm) thick layer of magnetizable material 601 coated on a web substrate 200 is determined as follows. The substrate is 0.0035 inch (0.09 mm) thick, moves at least 600 feet per minute, and is positioned against the magnetizing inductor 802 with the coated surface facing away from the inductor portion of the unit 801. The magnetizable material 601 must therefore be magnetized through this nominal 0.0035 inch gap formed by the substrate with a required field strength of 10,000 Oerstedt in the gap. This field strength is governed by the type of ferrite powder used in the formulations. The ferrite coated stripe or patch preferably has a width of 0.75 to 1.0 inch (1.9 to 2.5 cm). The magnetization shall result in magnetic poles 0.06 to 0.1 inch (1.5 to 2.5 mm) wide across the width of the stripe in a near continuous fashion. For 600 feet per minute, the pulse length should be between 3 and 10 microseconds at a rate of up to at least 20 pulses per second if the inductor is six inches long (20 pulses/sec×6 inch long inductor=10 ft/sec=600 ft/min). Longer pulses may cause the magnetic poles to overlap and run into each other, reducing their effectiveness.

Figure 8:
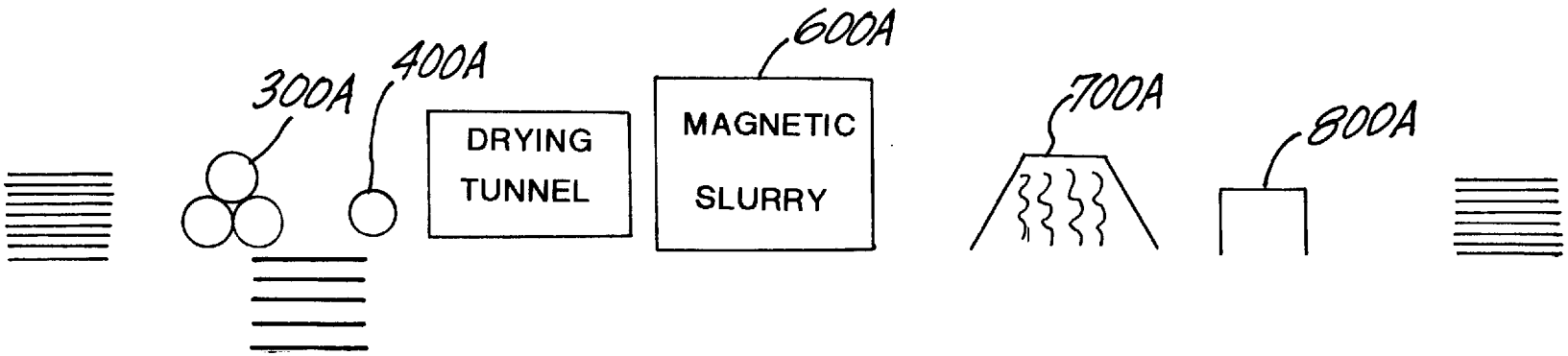
FIG. 8 is a schematic view of a sheet fed, but substantially similar process.

FIG. 8 is a schematic view of an alternate embodiment of the invention in a sheet feed (rather than a web) operation.

Figure 9:
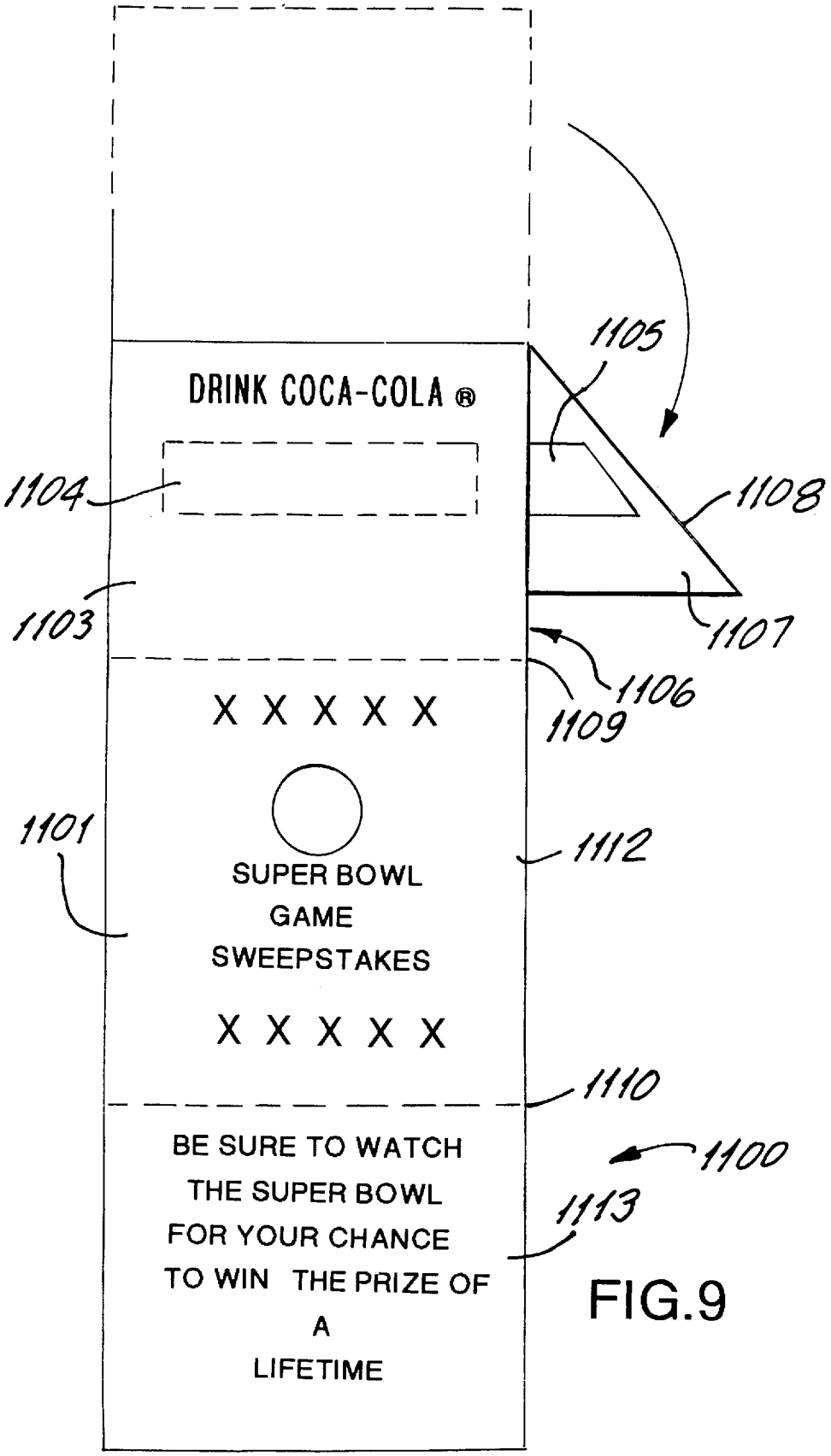
FIG. 9 is a perspective view of a typical magnetic product created by applicants' apparatus and process.

One such "in-line" finished product 1100, as shown in FIG. 9, has a large area 1101 of advertising below an upper segment 1103. The product 1100 contains a flat magnet comprising two applied magnetic layers 1104, 1105. One layer 1104 is on the underside 1106 of the upper segment 1103. The other layer 1105 is on the underside 1107 of a segment 1108 which is folded behind upper segment 1103 such that layers 1104 and 1105 "mate" and form a stronger magnet. Perforations 1109, 1110 may be provided at various places on product 1100. By making the appropriate perforations 1109, 1110, middle 1112 and lower 1113 segments of the product 1100 may be separated from the upper segment 1103, which could then remain as a residual, secondary advertisement. The detached non-magnetic advertisements 1112 and 1113 could be, for example, games, orders, sweepstakes, coupons, etc., which can be read, discarded, retained, used as a token or mailed in for a product, information, etc. In order to create such a product 1100, one could begin with, for example, a wide web 200 which would then be folded into smaller dimensions by, for example, folding station 750 after the magnetizable material is applied, and dried. One could then perforate the product 1100 in an in-line finishing technique shown in FIG. 1. Using a wide roll of paper, one can thus make the magnet portion a portion of a larger assembly.

Other applications of the products of the disclosed apparatus and process include domestic and commercial use of the magnets simply as magnets, or as a medium for messages or advertising, or for forms, labels, or markers for identification. Other contemplated uses include imprinting bar code strips using variable printing onto the magnetic strips. This feature may be useful in, for example, automotive parts and quality control applications. In such applications, the codes could be variably printed with ink jet printers. Another possible use could be selective magnetization of various substrates as in a game board which contains "magic areas."

While the preferred embodiments of the invention has been illustrated in detail, modifications and adaptations of such embodiments will be apparent to those skilled in the art. It is to be expressly understood however that such modifications and adaptations are within the spirit and scope of the present invention as set forth in the following claims.

We claim:

1. A method of in-line manufacturing of web-based and sheet-based magnetic products which attract iron-containing surfaces and are attachable thereto, the method comprising the steps of:

providing a substrate;

forming a slurry of a high coercivity magnetizable material having a thickness between 0.004" (0.1 mm) and 0.012" (0.5 mm), said slurry being formed by dispersing of substantially plate-like crystal structures in a binder which insures adhesion of the slurry to the substrate;

applying the slurry to the substrate;

drying the slurry, thereby creating a dried magnetizable layer on the substrate; and magnetizing the layer.

2. The method for the in-line manufacturing of magnetic products as in claim 1, wherein said substrate comprises a web.

3. The method for the in-line manufacturing of magnetic products as in claim 1, wherein said substrate comprises discrete sheets.

4. The method for the in-line manufacturing of magnetic products as in claim 1, further comprising the step of applying a solvent onto said substrate.

5. The method for the in-line manufacturing of magnetic products as in claim 1, wherein said substrate is in relative motion with respect to the application of said slurry and magnetization of said layer.

6. The method for the in-line manufacturing of magnetic products as in claim 1, further providing printing onto said substrate, wherein said printing is one of fixed and variable.

7. The method for in-line manufacturing of magnetic products in claim 6, further including drying said printing.

8. The method for the in-line manufacturing of magnetic products as in claim 6, wherein said printing comprises an advertisement or message.

9. The method for the in-line manufacturing of magnetic products as in claim 6, wherein said printing is performed by lithography.

10. The method for the in-line manufacturing of magnetic products as in claim 6, wherein said printing is performed by flexography.

11. The method for the in-line manufacturing of magnetic products as in claim 6, wherein said printing is performed by gravure process.

12. The method for the in-line manufacturing of magnetic products as in claim 6, wherein said printing is performed by silk screening.

13. The method for in-line manufacturing of magnetic products as in claim 1, further comprising in-line folding stations.

14. The method for the in-line manufacturing of magnetic products as in claim 1, further providing cutting or scoring said substrate.

15. The method for in-line manufacturing of magnetic products as in claim 1, wherein said manufacturing is performed at substrate printing press speeds.

16. The method for the in-line manufacturing of magnetic products as in claim 1, wherein said magnetic products are flexible.

17. The method for the in-line manufacturing of magnetic products as in claim 1, wherein said magnetizable material comprises a ferrite coating.

18. The method for the in-line manufacturing of magnetic products as in claim 17, wherein said solvent comprises water.

19. The method for the in-line manufacturing of magnetic products as in claim 17, wherein said solvent is organic.

20. The method for in-line manufacturing of magnetic products as in claim 1, further comprising in-line gluing stations.

21. The method for the in-line manufacturing of magnetic products as in claim 1, wherein said binder comprises a polymeric material.

22. The method for the in-line manufacturing of magnetizable products as in claim 1, wherein said application of magnetic material is performed by a reverse wheel process.

23. The method for the in-line manufacturing of magnetic products as in claim 1, wherein said application of magnetic material is performed by a direct wheel process.

24. The method for the in-line manufacturing of magnetic products as in claim 1, wherein said application of magnetic material is performed by extrusion.

25. The method for the in-line manufacturing of magnetic products as in claim 1, wherein said binder comprises one or more of the following: an acrylic material, a vinyl material, a polyamide, a polyester, a wax, a silicate, a dryable oil, a cellulosic material, a polyurethane or silicone material.

26. The method for the in-line manufacturing of magnetic products as in claim 1, further providing laminating two magnetizable layers by folding said substrate to form a single magnetizable layer of approximately twice the thickness of each of said two magnetizable layers.

27. The method for the in-line manufacturing of magnetic products, as in claim 1, wherein said magnetization process is performed by a permanent magnet.

28. The method for the in-line manufacturing of magnetic products as in claim 1, wherein said magnetization process is performed by electrical induction.

29. The method for the in-line manufacturing of magnetic products as in claim 1, wherein said application of magnetic material is performed by a doctor blade assembly.

30. The method for the in-line manufacturing of magnetic products as in claim 1, further comprising the step of applying a polymeric undercoating to said substrate.

31. The method for the in-line manufacturing of magnetic products as in claim 1, wherein said drying is performed by hot air.

32. The method for the in-line manufacturing of magnetic products as in claim 1, wherein said drying is performed in a drying tunnel.

33. The method for the in-line manufacturing of magnetic products as in claim 1, wherein said drying is performed with an infrared heating element.

34. The method for the in-line manufacturing of magnetic products as in claim 1, wherein said application of magnetic material is performed by screen printing.

35. The method for the in-line manufacturing of magnetic products as in claim 1, wherein said application of magnetic material is performed by direct roller technique.

* * * * *